US010249286B1

(12) United States Patent
Mani

(10) Patent No.: US 10,249,286 B1
(45) Date of Patent: Apr. 2, 2019

(54) ADAPTIVE BEAMFORMING USING KEPSTRUM-BASED FILTERS

(71) Applicant: KAAM LLC., Saratoga, CA (US)

(72) Inventor: Senthil Kumar Mani, Hyderabad (IN)

(73) Assignee: KAAM LLC, Saratoga, CA (US)

( * ) Notice: Subject to any disclaimer, the term of this patent is extended or adjusted under 35 U.S.C. 154(b) by 0 days.

(21) Appl. No.: 15/951,703

(22) Filed: Apr. 12, 2018

(51) Int. Cl.
*G10K 11/178* (2006.01)
*H04R 3/00* (2006.01)

(52) U.S. Cl.
CPC ..... *G10K 11/178* (2013.01); *H04R 3/005* (2013.01); *G10K 2210/3028* (2013.01)

(58) Field of Classification Search
CPC .... H04R 3/002; G10K 11/178; G10K 11/175; G10K 11/346; G10K 11/34; G10K 2210/3028; G10K 2200/10; G10L 21/0208; G10L 21/02; G10L 21/0216; G10L 21/0224
USPC ..... 381/71.1, 71.11, 71.12, 73.1, 71.8, 94.1, 381/92, 94.7
See application file for complete search history.

(56) References Cited

U.S. PATENT DOCUMENTS 3,662,108 A * 5/1972 Flanagan ..... G10K 11/178 367/49
5,566,675 A * 10/1996 Li ..... G01S 7/52049 600/447
2008/0019538 A1* 1/2008 Kushner ..... A62B 18/08 381/94.1
2009/0073040 A1* 3/2009 Sugiyama ..... G01S 3/04 342/378
2009/0271187 A1* 10/2009 Yen ..... G10L 21/0208 704/226
2010/0246851 A1* 9/2010 Buck ..... G10L 21/0208 381/94.1
2014/0119568 A1* 5/2014 Yu ..... H04R 3/005 381/92

OTHER PUBLICATIONS

Jeong, et al., "A Real-time Kepstrum Approach to Speech Enhancement and Noise Cancellation", vol. 71, Issues 13-15, Aug. 2008, pp. 2635-2649.
Jeong, et al., "Kepstrum Approach to Real-time Speech Enhancement Methods Using Two Microphones", Nov. 2005.

* cited by examiner

*Primary Examiner* — Ahmad F. Matar
*Assistant Examiner* — Sabrina Diaz
(74) *Attorney, Agent, or Firm* — Chip Law Group

(57) ABSTRACT

A signal processing system, as disclosed herein, generates a filtered signal from a plurality of input signals, comprising a first type of signal and a second type of signal, received from each of a plurality of signal capturing terminals. For each signal frame, a first resultant estimate of the first type of signal in each of the plurality of input signals is determined based on a first impulse response of a corresponding first content adaptive filter. For each signal frame, a second resultant estimate of the first type of signal in a composite signal is determined based on a second impulse response of a second content adaptive filter. Phase information of an estimated interference signal obtained from the second content adaptive filter is restored and the first type of signal is extracted from the filtered signal.

33 Claims, 5 Drawing Sheets

ADAPTIVE BEAMFORMING USING KEPSTRUM-BASED FILTERS

CROSS-REFERENCE TO RELATED APPLICATIONS/INCORPORATION BY REFERENCE

None.

FIELD OF TECHNOLOGY

Certain embodiments of the disclosure relate to digital signal processing. More specifically, certain embodiments of the disclosure relate to system, method, and apparatus for adaptive beamforming using Kepstrum filters.

BACKGROUND

Spatial filtering or beamforming is a spatio-temporal technique for wireless communication, speech processing, medical diagnostics, and other applications that require establishing the transmitting direction of target signals in a signal cluttered environment. Human machine interface applications, such as virtual voice assistant using automatic speech recognition (ASR), form the basis of online authentication, access and service management for today's on-the-move users. Such operations require extraction as well as enhancement of speech of the user from noisy signals in the signal cluttered environment, irrespective of the physical location of the user.

Spatial filtering is usually implemented using fixed and adaptive beamforming techniques. The adaptive beamforming technique employs multiple adaptive filters that use estimation errors with fixed and adaptive step size to dynamically update the filtering criteria for removing non-stationary noise elements. However, such adaptive filters converge and diverge for any change in the direction of a target signal as well as switching across the target signal and interference signal during a talk-spurt classification error. Depending upon the step size and changes in surrounding conditions, numerous iterations may be undertaken to achieve a desired degree of clarity of the target signal. Therefore, a dynamic, robust, and adaptive spatial filtering technique is desired that may overcome the aforesaid problems.

Further limitations and disadvantages of conventional and traditional approaches will become apparent to one of skill in the art, through comparison of such systems with some aspects of the present disclosure as set forth in the remainder of the present application with reference to the drawings.

BRIEF SUMMARY OF THE DISCLOSURE

A system, method, and/or apparatus are provided for adaptive beamforming using Kepstrum filters, substantially as shown in and/or described in connection with at least one of the figures, as set forth more completely in the claims.

These and other advantages, aspects, and novel features of the present disclosure, as well as details of an illustrated embodiment thereof, will be more fully understood from the following description and drawings.

DETAILED DESCRIPTION OF THE DISCLOSURE

Figure 1:
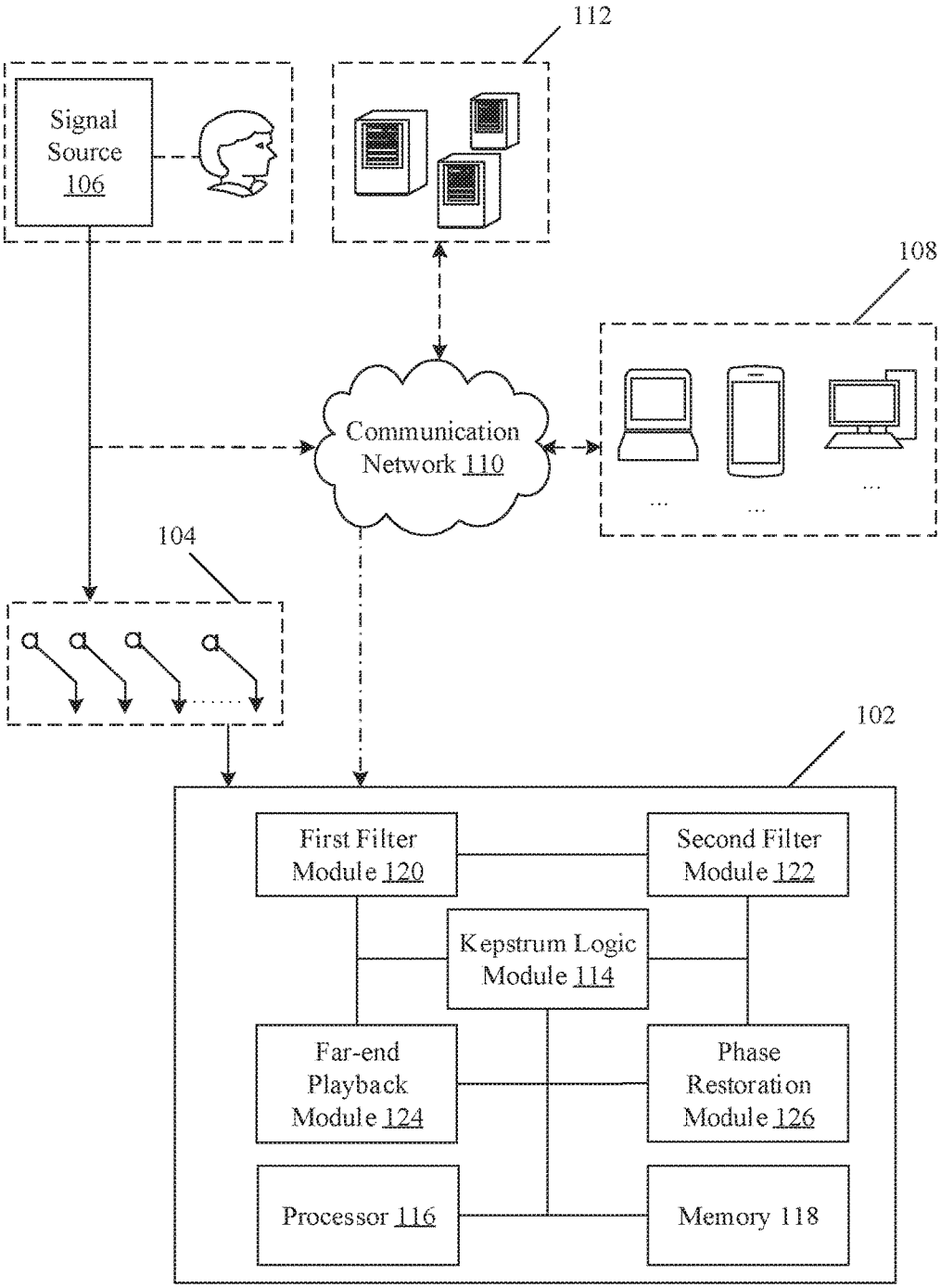
FIG. 1 is a block diagram that illustrates an exemplary network environment for a system for adaptive beamforming using Kepstrum filters, in accordance with an exemplary embodiment of the disclosure.

Certain embodiments of the disclosure may be found in a system, method and apparatus for adaptive beamforming using Kepstrum filters. Various embodiments of the disclosure may provide a system, comprising a plurality of circuits in a signal processing apparatus. The plurality of circuits (hereinafter referred to as "circuits") may be configured to generate a filtered signal from a plurality of input signals. The plurality of input signals may be received from each of a plurality of signal capturing terminals. Each of the plurality of input signals may comprise a first type of signal and a second type of signal. The circuits may be further configured to determine, for each signal frame, a first resultant estimate of the first type of signal in the plurality of input signals, received from each of the plurality of signal capturing terminals. Each of the plurality of signal capturing terminals corresponds to a unidirectional terminal and each signal frame is a burst of sound signals of a defined duration. The first resultant estimate is determined based on a first impulse response of each first content adaptive filter of a plurality of first content adaptive filters. The circuits may be further configured to determine, for each signal frame, a second resultant estimate of the first type of signal in a composite signal based on a second impulse response of a second content adaptive filter. The circuits are further configured to restore phase information of an estimated interference signal, obtained from the second content adaptive filter. The adaptive filter, such as a Normalized Least Mean Square (NLMS) filter, may be configured to obtain a phase restored interference signal. In addition, the circuits may be further configured to extract the first type of signal from the filtered signal based on filtration of the phase restored interference signal from the filtered signal.

In accordance with an embodiment, the circuits are further configured to estimate, for each signal frame, a new first filter coefficient for each of the plurality of first content adaptive filters. The new first filter coefficient is estimated when the content of each signal frame of the filtered signal is different from content of each signal frame of a target signal (first type of signal). In accordance with another embodiment, the circuits are further configured to utilize a previously estimated first filter coefficient for each of the plurality of first content adaptive filters. The previously estimated first filter coefficient is utilized when the content of each signal frame of the filtered signal is equal to the content of each signal frame of the target signal. In accordance with an embodiment, the circuits are further configured to estimate a second filter coefficient for each of the plurality of first content adaptive filters. The circuits may be further configured to determine a first resultant filter coefficient for each of the plurality of first content adaptive filters based on comparison of the first filter coefficient and the second filter coefficient for each signal frame in real time.

The first resultant filter coefficient corresponds to the first resultant estimate (as evaluated above).

In accordance with an embodiment, the circuits are further configured to estimate the first impulse response based on the estimated first filter coefficient and the estimated second filter coefficient for each first content adaptive filter of the plurality of first content adaptive filters. The first impulse response is estimated based on the determined first resultant filter coefficient.

In accordance with an embodiment, the circuits are further configured to, for each signal frame, estimate a new third filter coefficient for the second content adaptive filter. The new third filter coefficient is estimated when the content of each signal frame in the filtered signal is different from content of each signal frame of a target signal. In accordance with another embodiment, the circuits are further configured to utilize a previously estimated third filter coefficient for the second content adaptive filter. The previously estimated third filter coefficient is utilized when the content of each signal frame of the filtered signal is equal to content of each signal frame of a target signal. The circuits are further configured to estimate a fourth filter coefficient for the second content adaptive filter based on estimation of the first type of signal in the composite signal.

In accordance with an embodiment, the circuits are further configured to determine, for each signal frame, a second resultant filter coefficient based on comparison of an estimated third filter coefficient and an estimated fourth filter coefficient for the second content adaptive filter. The second resultant filter coefficient corresponds to the second resultant estimate (as evaluated above). In accordance with an embodiment, the circuits are further configured to estimate the second impulse response based on the estimated third filter coefficient and the estimated fourth filter coefficient. The third filter coefficient and the fourth filter coefficient are adapted for each signal frame based on content of each signal frame in real time. The second impulse response is estimated based on the determined second resultant filter coefficient.

In accordance with an embodiment, the circuits are further configured to receive the first type of signal and the second type of signal as the plurality of input signals. The second type of signal is further filtered from the plurality of input signals based on a direction of arrival of each of the plurality of input signals to obtain the filtered signal.

In accordance with an embodiment, the first type of signal may correspond to a target signal. The second type of signal may correspond to a plurality of interference signals. The plurality of interference signals may comprise at least one of ambient noise, babble noise, and reverberation. The circuits may be further configured to filter the second type of signal in the filtered signal to obtain a processed first type of signal. In accordance with an embodiment, each of the plurality of first content adaptive filters and the second content adaptive filter may be implemented by use of a Kepstrum filter in time domain.

FIG. 1 is a block diagram that illustrates an exemplary network environment for a system for adaptive beamforming using Kepstrum filters, in accordance with an exemplary embodiment of the disclosure. Referring to FIG. 1, there is shown a communication environment 100 for frame-wise Kepstrum-based spatial filtering of noisy signals in real time. The communication environment 100 may include a signal processing apparatus 102, a plurality of signal capturing terminals 104, a signal source 106, one or more communication devices 108, a communication network 110, and a data server 112. As illustrated in FIG. 1, the signal processing apparatus 102 may include a Kepstrum logic module 114, a processor 116, a memory 118, a first filter module 120, a second filter module 122, a far-end playback module 124, and a phase restoration module 126. The Kepstrum logic module 114, the processor 116, the memory 118, the first filter module 120, the second filter module 122, the far-end playback module 124 and the phase restoration module 126 may be coupled to each other. The plurality of signal capturing terminals 104, and the one or more of the communication devices 108 may be communicatively coupled to the signal processing apparatus 102. The data server 112 may be further coupled to the signal processing apparatus 102 via the communication network 110. The one or more the communication devices 108 may also be coupled to the data server 112 via the communication network 110. The disclosure may not be limited, and in accordance with another embodiment, the signal processing apparatus 102, the plurality of signal capturing terminals 104, one of the one or more communication devices 108 may be integrated to form a single entity, without deviation from the scope of the disclosure.

The communication environment 100 may correspond to a closed environment, or an open environment. Examples of the closed environment may include, but are not limited to, interiors of offices, stores, vehicles, indoor stadiums, airplane, and halls. Examples of the open environment may include, but not limited to, road, outdoor stadiums, swimming pools, rocky terrains, ship decks, or other outdoor spaces. At least one noise signal may propagate as omnidirectional field with equal probability within the communication environment 100. Alternatively, the communication environment 100 may be a far-field communication environment, such as special chamber lined with anechoic material, which supports far-field transmission and reception of signals from multipath channels.

The signal processing apparatus 102 may comprise suitable logic, circuitry, and interfaces that may be configured to perform spatial filtration and enhancement of desired signal components, such as speech signals, from a plurality of input signals. The frame-wise spatial filtration and enhancement of desired signal components may be performed based on implementation of content adaptive filters, such as Kepstrum filters. Such Kepstrum filters are also referred to as Complex Cepstrum filters. The signal processing apparatus 102 may be an apparatus that performs a defined set of operations. Examples of the defined set of operations may include, but are not limited to, determination of signal amplification and filtration coefficients, one or more discrete signal transforms, one or more filter coefficients, one or more responses, or signal arithmetic. Each operation of the defined set of operations may be performed by the signal processing apparatus 102 in conjunction with stored logic and/or circuitries. Such logic and/or circuitries may be implemented as a set of instructions or in a programmable logic device which may include hardware with computer programmable and logically connected circuitries. The signal processing apparatus 102 may include at least one processor with or without multiple cores.

The signal processing apparatus 102 may be configured for directional selectivity of the incident plurality of input signals at the plurality of signal capturing terminals 104. In another embodiment, the signal processing apparatus 102 may be configured for frequency selectivity of the incident plurality of input signals at the plurality of signal capturing terminals 104.

The plurality of signal capturing terminals 104 may comprise suitable logic, circuitry, and interfaces that may be configured to capture a plurality of input signal from different direction of arrivals (DOAs). The plurality of signal capturing terminals 104 may include a plurality of individual transducers arranged as an array. The array of individual transducers may be arranged in a linear topology but other arrangements, such as, but not limited to, circular, elliptical, zigzag or random arrangements may be employed without deviating from the scope of the disclosure. Alternatively, the plurality of signal capturing terminals 104 may include sensors, such as, but not limited to, antenna(s), medical diagnostics sensors, seismic sensors, machine fault diagnostic sensors. A spatial separation between the different individual transducer(s) and an orientation of the transducer(s) with respect to the signal processing apparatus 102, and the signal source 106 may adhere to pre-requisites of the communication environment 100. In accordance with an embodiment, the transducers may be of omnidirectional polarity. In accordance with another embodiment, the transducers may be of unidirectional polarity. In other words, each of the plurality of signal capturing terminals 104 may be a unidirectional terminal or an omnidirectional terminal.

The signal source 106 may comprise suitable logic, circuitry, and interfaces that may be configured to generate a plurality of input signals for a target listener, which may be a user, a device, or an audience. The signal source 106 may be a human user physically present within the communication environment 100. In an embodiment, the signal source 106 may be a playback of a pre-recorded speech (signal) or a user at a distant location interacting with the signal processing apparatus 102 via the communication network 110. The plurality of input signals comprises a first type of signal and second type of signal. In accordance with an embodiment, the first type of signal may correspond to a target signal (speech) and the second type of signal may correspond to a plurality of interference signals which may further correspond to the at least one noise signal. Examples of the first type of signal may include, but are not limited to, speech signals, sound signals, audio signals, Radio Frequency (RF) signals, microwave signals, and seismic signals. Examples of the at least one noise signal may include, but are not limited to, babble noise, ambient noise, hamming noise, static noise, electromagnetic signal interference, adjacent channel interference, crosstalk, inter-symbol interference, inter-carrier interference, and common mode interference.

The one or more communication devices 108 may comprise suitable logic, circuitry, and interfaces that may be configured to receive a processed first type of signal (speech) from the signal processing apparatus 102. Each communication device may be a networked or a stand-alone computation device that may be configured to perform one or more tasks. The one or more tasks may include, but are not limited to, storage, broadcast, speech-to-text translation, speech-to-speech translation, and speech analysis tasks. Examples of the one or more communication devices 108 may include, but are not limited to, workstations, servers, laptops, desktop computers, mobile devices, non-mobile devices, input/output (I/O) devices, and virtual machines.

The communication network 110 may comprise suitable logic, circuitry, and interfaces that may be configured to provide a plurality of network ports and a plurality of communication channels for transmission and reception of data. Each network port may correspond to a virtual address (or a physical machine address) for transmission and reception of the communication data. For example, the virtual address may be an Internet Protocol Version 4 (IPV4) (or an IPV6 address) and the physical address may be a Media Access Control (MAC) address. The communication network 110 may be associated with an application layer for implementation of communication protocols based on one or more communication requests from at least one of the one or more communication devices 108. The communication data may be transmitted or received based on the communication protocols. Examples of the communication protocols may include, but are not limited to, HTTP (Hypertext Transfer Protocol), FTP (File Transfer Protocol), SMTP (Simple Mail Transfer Protocol), DNS (Domain Network System) protocol, and CMIP (Common Management Interface Protocol).

In accordance with an embodiment, the communication data may be transmitted or received via at least one communication channel of the plurality of communication channels in the communication network 110. The communication channels may include, but are not limited to, a wireless channel, a wired channel, and a combination of wireless and wired channel thereof. The wireless or wired channel may be associated with a data standard which may be defined by one of a Local Area Network (LAN), a Personal Area Network (PAN), a Wireless Local Area Network (WLAN), a Wireless Sensor Network (WSN), a Wireless Area Network (WAN), and a Wireless Wide Area Network (WWAN). Additionally, the wired channel may be selected on the basis of bandwidth criteria. For example, an optical fiber channel may be used for a high bandwidth communication. Further, a coaxial cable-based or Ethernet-based communication channel may be used for moderate bandwidth communication.

The data server 112 may comprise suitable logic, circuitry, and interfaces that may be configured to receive, manage, store, and communicate data with at least one of the signal processing apparatus 102 and the one or more communication devices 108 via the communication network 110. The data handled by the data server 112 may refer to digitized storable version of the plurality of input signals from the signal source 106 or the processed first type of signal from the signal processing apparatus 102. The data server 112 may be further configured to store a defined set of characteristics, a set of computations, a set of signal processing models, and a set of parameters associated with one or more of the aforesaid. The data in the data server 112 may be stored and managed as a collated, uncollated, structured, or unstructured set of databases in real time.

The Kepstrum logic module 114 may comprise suitable logic, circuitry, and interfaces that may be configured to perform a Kepstrum estimation of a power spectrum of a random signal convoluted with a transfer function of a given system. An inverse transformation from frequency to time domain may be performed on the absolute logarithmic value of a time domain to frequency domain convolution of the random signal.

The processor 116 may comprise suitable logic, circuitry, and interfaces that may be configured to facilitate computations based on a set of instructions. The processor 116 may correspond to generic n-bit architecture-based processor. The n-bit architecture may be associated to binary arithmetic-based address and/or data bus dedicated and/or multiplexed architecture. Examples of n-bit architecture include, but are not limited to, 2, 4, 8, 16, 32, 64, 2n bit-based architecture. Here, "n" corresponds to a size of each register, address bus, or data bus of the processor 116. The management of the address bus, the data bus, and general arithmetical, logical, or graphical processes may be performed by the processor 116 on the basis of the set of instructions, stored in the memory 118 of the signal processing apparatus 102. The processor 116 may also execute a set of instructions from one or one or more communication devices 108 and/or data server 112. Each of the set of instructions may correspond to at least one of an arithmetical, logical, or graphical computation task. Examples of the computation task may include, but are not limited to, a computation of transforms, responses, quantization, samples, compression factors, and filter coefficients. The set of instructions may further correspond to an authentication, authorization, and/or a validation task. The signal processing apparatus 102 may include a programmable logic device which may include hardware with computer programmable and logically connected circuitries. Examples of the programmable logic device may include, but are not limited to, a Field Programmable Gate Array (FPGA) and a Complex Programmable Logic Device (CPLD). In yet another embodiment, the signal processing apparatus 102 may include a distributed network of FPGA architecture. Alternatively, the signal processing apparatus 102 may also include Programmable Application Specific Integrated Circuits (PL-ASIC) architecture or may be partially or completely implemented on at least one of an ASIC or a combination of ASIC, FPGA/CPLD architectures.

The memory 118 may comprise suitable logic, circuitry, and interfaces that may be configured to store the set of instructions executable by the processor 116. Additionally, the memory 118 may be configured to receive the set of instructions (programmable) from one or one or more communication devices 108 and/or the data server 112 through the communication network 110. The memory 118 may exhibit volatile or non-volatile characteristics. Examples of the memory 118 may include, but are not limited to, a magnetic storage drive, a solid state drive, Programmable Read Only Memory (PROM), Erasable PROM (EPROM), Electrically EPROM (EEPROM), and a flash memory. In another embodiment, a set of centralized or distributed network of peripheral memory devices may be interfaced with the signal processing apparatus 102, such as a cloud server.

The first filter module 120 may comprise suitable logic, circuitry, and interfaces that may be configured to amplify a desired portion in the plurality of input signals and reject remnant portion of the plurality of input signals emanating from the signal source 106. In a specific implementation, the first filter module 120 is an operational component of a spatial beamformer. The first filter module 120 may include first type of filters, such as adaptive filters or Weiner filters. Each first type of filter in the first filter module 120 may be associated with a corresponding terminal of the plurality of signal capturing terminals 104. A number of input ports in the first filter module 120 may be dependent on a number of signal capturing terminal(s) in the plurality of signal capturing terminals 104. For example, for 8 microphones as signal capturing terminals, the first filter module 120 may comprise 8 input ports. Parameters for operation of the first filter module 120 may be dependent on the relative separation between each terminal of the plurality of signal capturing terminals 104 and the number of signal capturing terminals or input ports in the first filter module 120. Optimum filter coefficients may determine an optimum impulse response of each of the first type of filters in the first filter module 120.

The first type of filters in the first filter module 120 may be digital filters, modelled on a Finite Impulse Response (FIR) filter. As FIR is implemented in time domain, the first filter module 120 may process convoluted signals (input signals) based on an optimum impulse response of the implemented FIR filters to generate a desired output signal. The first type of filters in the first filter module 120 may correspond to one of a linear time invariant filter, a casual type filter and a non-recursive filter.

In accordance with an embodiment, each filter in the first filter module 120 may be designed and simulated using Computer Aided Design (CAD) tools, such as, but not limited to, Matrix laboratory (MATLAB), Laboratory Virtual Instrument Engineering Workbench (LabVIEW), and Octave. In accordance with another embodiment, each filter in the first filter module 120 may be designed using computer compatible Hardware Description Languages (HDLs), such as, but not limited to, Verilog, System Verilog, Very Large Scale Integration (VLSI) HDL, and CAD tools.

The second filter module 122 may comprise suitable logic, circuitry, and interfaces that may be configured to estimate the first type of signal and filter the first type of signal from the plurality of input signals. The second filter module 122 may include second type of filters, which may further comprise a plurality of first content adaptive filters in a speech cancelling path and a second content adaptive filter in multiple input cancellation path. Each of the plurality of first content adaptive filters in the second filter module 122 may be associated with a corresponding signal capturing terminal of the plurality of signal capturing terminals 104. Each of the plurality of first content adaptive filters may be configured to filter the first type of signal in the plurality of input signals, captured at respective signal capturing terminal of the plurality of signal capturing terminals 104. Accordingly, the second content adaptive filter may be configured to further filter the first type of signal from the filtered plurality of input signals. The plurality of first content adaptive filters and the second content adaptive filter in second filter module 122 may be digital filters, such as Kepstrum filters. Each of the plurality of first content adaptive filters and the second content adaptive filter in the second filter module 122 may correspond to at least one of an FIR filter, a linear time invariant filter, a casual type filter, and a non-recursive filter. As FIR is implemented in time domain, the second filter module 122 may process convoluted signals based on an optimum impulse response of implemented FIR filters to further generate a desired output signal.

In accordance with an embodiment, the plurality of first content adaptive filters and the second content adaptive filter of the second filter module 122 may be designed and simulated using Computer Aided Design (CAD) tools, such as, but not limited to, Matrix laboratory (MATLAB), Laboratory Virtual Instrument Engineering Workbench (LabVIEW), and Octave. In accordance with another embodiment, each of the plurality of first content adaptive filters and the second content adaptive filter in the second filter module 122 may be designed using computer compatible Hardware Description Languages (HDLs), such as, but not limited to, Verilog, System Verilog, Very Large Scale Integration (VLSI) HDL and CAD tools. The signal processing apparatus 102 may employ a combination of the first filter module 120 and the second filter module 122 to perform multistage spatial filtering.

The far-end playback module 124 may comprise suitable logic, circuitry, and interfaces that may be configured to generate far-end signals, modelled on audio data outputted from a far-end signal source, such as a loudspeaker. In certain cases, the far-end signals of the far-end playback module 124 may be reverberation signals which may be a phase delayed version of the first type of signal, captured at the plurality of signal capturing terminals 104.

The phase restoration module 126 may comprise suitable logic, circuitry, and interfaces that may be configured to restore a phase loss of the processed signal post estimation of content adaptive filters. The phase restoration module 126 may implement an optimization technique to restore the phase of the processed signals. The optimization technique may be performed to obtain a minimal difference in the desired filter output and the obtained filter output. Examples of the optimization technique may include, but are not limited to, Least Mean Square (LMS), Recursive Least Squares (RLS), filtered-x LMS, and Normalized Least Mean Square (NLMS) technique. In accordance with an embodiment, an NLMS adaptive filter, modelled as an adaptive FIR filter in a closed loop, may be used to restore the phase of the processed signals.

In operation, a plurality of input signals is received at the plurality of signal capturing terminals 104. The plurality of input signals is received along a direction vector that represents a look direction or a specific direction of arrival (DOA) and points at the plurality of signal capturing terminals 104. The plurality of input signals is a composite signal that comprises a first type of signal representing the target speech of the target user and a second type of signal representing a composite interference or noise signal. At least one constituent of the second type of signal (or composite interference signal) may be obtained from the multiple reflections of the first type of signal at the surfaces of structures and/or materials in the communication environment 100. Such multiple reflections of the first type of signal may exhibit change in characteristics of the first type of signal. Examples of the changes in characteristics may include, but are not limited to, phase deviations, amplitude decay, and frequency deviations. Such reflections, reverberations and the other noises may be constituents of the second type of signal. Therefore, the plurality of signal capturing terminals 104 may capture the first type of signal as well as the second type of signal, collectively referred to as the plurality of input signals.

A correlation may exist between the first type of signal and the second type of signal in the received plurality of input signals. The degree of correlation between the first type of signal and the second type of signal may be based on the type of the communication environment 100, such as a closed environment or an open environment, which further promotes reflections or reverberations of the first type of signal. The degree of correlation may be further based on location of the signal source 106 with respect to location of the plurality of signal capturing terminals 104 in the communication environment 100.

In accordance with an embodiment, the signal processing apparatus 102 may be directly coupled with the plurality of signal capturing terminals 104 to receive the plurality of input signals emanating from the signal source 106. In accordance with another embodiment, the signal processing apparatus 102 may be coupled with the plurality of signal capturing terminals 104, via the communication network 110, to receive the plurality of input signals emanating from the signal source 106. In accordance with yet another embodiment, the signal processing apparatus 102 may be coupled with the data server 112 which may be further coupled with the plurality of signal capturing terminals 104. The data server 112 may store sampled and digitally compressed or uncompressed files for different frames of the plurality of input signals emanating from the signal source 106, and further transmit the store files to the signal processing apparatus 102, via the communication network 110.

As the signal processing apparatus 102 receives the plurality of input signals from the plurality of signal capturing terminals 104, the signal processing apparatus 102 may be configured to digitize the received plurality of input signals. The signal processing apparatus 102 may be further configured to packetize the received plurality of input signals as a set of signal frames, where each signal frame is a burst of sound signal of a defined duration, such as 10 milliseconds. Each signal frame may be associated with various attributes, such as a bit rate, a duration, a sampling frequency, and a number of channels.

Although not shown in FIG. 1, the signal processing apparatus 102 may also include signal preparation circuits for modifying signal in a suitable format prior to application of spatial filtering, as known to one skilled in the art and therefore, not described herein for the sake of brevity. Examples of the signal preparation circuits include, but are not limited to, Analog to Digital (A/D) converters, Digital to Analog (D/A) converters, samplers, multiplexers, de-multiplexers, coders, decoders, packet formers, and quantizers.

For each signal frame, the signal processing apparatus 102 may be configured to retrieve and execute a set of instructions stored in the memory 118, using computational resources of the processor 116. The set of instructions may be further shared with different operational components of the signal processing apparatus 102, which includes the Kepstrum logic module 114, the first filter module 120, the second filter module 122, the far-end playback module 124, and the phase restoration module 126.

The first filter module 120 may be configured to amplify the first type of signal in the received plurality of input signals on the basis of an angle of incidence (or DOA) of the plurality of input signals at the plurality of signal capturing terminals 104. The first filter module 120 may be configured to constructively combine the plurality of input signals from a specific angle of incidence (or particular DOA) at the plurality of signal capturing terminals 104 and destructively combine the plurality of input signals at angles of incidence (or DOAs) different from the specific angle of incidence (or DOA). The constructive and destructive combination of the plurality of input signals may establish a signal pattern exhibiting a beam with a main lobe towards an estimated position of the plurality of signal capturing terminals 104 and may be referred to as fixed beamforming. The details of fixed beamforming is provided in detail in FIG. 2. The directional sensitivity may enable the signal processing apparatus 102 to focus on the plurality of input signals from the estimated position of the signal source 106 in the communication environment 100 and therefore, may prevent acquisition of the plurality of signals from undesired DOAs.

For a first signal frame, the first filter module 120 may amplify and combine the first type of signal and filter the second type of signal in a plurality of input signals that are received to generate a filtered signal. The filtered signal may still include remnants of the second type of signal and the beamformed first type of signal. In other words, a correlation may exist between the filtered signal and the second type of signal in the received plurality of input signals. Therefore, further filtration may be required to cancel the remnant portion of the second type of signal in the filtered signal.

For such filtration, an optimum estimate of the second type of signal (or the composite interference signal) may be required and such optimum estimate may be derived based on feeding the received plurality of input signals through a speech cancellation path and a multiple input cancellation path. Thereafter, phase compensation or restoration may be performed to obtain such optimum estimate of the second type of signal. Such estimate may be subtracted from the filtered signal to obtain the final output signal (processed target speech signal).

For the speech cancellation path, the plurality of input signals may be provided to the plurality of first content adaptive filters of the second filter module 122. The filtered signal may be further provided to the plurality of first content adaptive filters of the second filter module 122. The Kepstrum logic module 114, in conjunction with the plurality of first content adaptive filters, analyzes the filtered signal to determine a first Kepstrum estimate of the first type of signal in the filtered signal. The first Kepstrum estimate is hereinafter referred to as a first estimate of the first type of signal in the filtered signal.

The Kepstrum logic module 114, in conjunction with the plurality of first content adaptive filters, performs a Kepstrum analysis of the received plurality of input signals to generate a plurality of Kepstrum estimates. Each Kepstrum estimate may be obtained for an input signal at a respective signal capturing terminal of the plurality of signal capturing terminals 104. The plurality of Kepstrum estimates is hereinafter referred to as a second estimate. The second estimate may be an estimate of the first type of signal in the corresponding plurality of input signals.

During estimation, the first estimate and the second estimate may be initialized with zero values and each of the first estimate and the second estimate may be further updated as the estimation continues for each signal frame of the filtered signal or the plurality of input signals in real time.

The first estimate and the second estimate are compared frame wise by the Kepstrum logic module 114 to determine a first resultant Kepstrum estimate (hereinafter referred to as a first resultant estimate). The first resultant estimate may be an optimum estimate of the first type of signal for each signal capturing terminal that receives the plurality of input signals. Alternatively, the first resultant estimate may provide a near estimate of the first type of signal in plurality of input signals for each signal capturing terminal that receives the plurality of input signals. Each first resultant estimate may be used to determine filtering criteria for a corresponding first content adaptive filter of the plurality of first content adaptive filters in the second filter module 122. The filtering criteria may correspond to optimal resultant filter coefficients for the plurality of first content adaptive filters of the second filter module 122.

For subsequent signal frames, the Kepstrum logic module 114 may check for content in the instantaneous signal frame. The Kepstrum logic module 114 may retain the first estimate or generate a new first estimate depending on content detected in the instantaneous signal frame. The Kepstrum logic module 114 may further determine each of new second estimate for corresponding plurality of input signals captured at respective terminal of the plurality of signal capturing terminals 104 for the instantaneous signal frame.

The comparison of the first estimate or the new first estimate with each of the new second estimate may be performed to determine each of new first resultant estimate for the instantaneous signal frame. Each of the new first resultant estimate for the instantaneous signal frame may be used to determine new filtering criteria for the plurality of first content adaptive filters in the second filter module 122. Each new filtering criteria for the plurality of first content adaptive filters in the second filter module 122 may be used to block the first type of signal from the corresponding plurality of input signals. Therefore, output signal from each of the plurality of first content adaptive filters in the second filter module 122 may provide a near optimal estimate of the second type of signal in corresponding plurality of input signals at each instant. The plurality of first content adaptive filters in the second filter module 122 may be collectively referred to as a blocking matrix, operational based on instantaneous Kepstrum analysis of signal frames. Details of such blocking matrix are provided in description of FIG. 2.

As Kepstrum estimation may be performed on the plurality of input signals, output signal of each first content adaptive filter of the plurality of first content adaptive filters in the second filter module 122 may lie in-phase with each other. The output of the first plurality of content adaptive filters may be referred to as a modelled second type of signal. The first type of signal may still exist as leaked signal in the modelled second type of signal, outputted from the plurality of first content adaptive filters. Such leaked first type of signal may exhibit negligible correlation with the second type of signal in the modelled second type of signal. The far-end signals from the far-end playback module 124 may be combined with each of the modelled second type of signal to generate a composite signal. The composite signal may include the leaked first type of signal that may exhibit a certain degree of correlation with the second type of signal.

For multiple input cancellation path, the composite signal may be provided to the second content adaptive filter of the second filter module 122. The Kepstrum logic module 114, in conjunction with the second content adaptive filter, analyzes the filtered signal from the first filter module 120 to determine a third Kepstrum estimate of the first type of signal in the filtered signal. The third Kepstrum estimate may be referred to as third estimate and may be an estimate of the first type of signal in the filtered signal of the first filter module 120.

The Kepstrum analysis of the composite signal, generated at the far-end playback module 124, may be performed for the first frame and the subsequent frames of the composite signal. The Kepstrum logic module 114 may generate a fourth Kepstrum estimate (referred to as a fourth estimate) for the composite signal. The fourth estimate may be an estimate the first type of signal in the corresponding composite signal.

The third estimate and the fourth estimate may be compared by the Kepstrum logic module 114. A second resultant Kepstrum estimate (also referred to as a second resultant estimate) may be determined by the Kepstrum logic module 114 for the composite signal. Each second resultant estimate may provide near optimal estimate of the first type of signal in the composite signal. The second resultant estimate may be used to determine a filtering criteria for the second content adaptive filter to filter the composite signal. The second content adaptive filter (as part of multiple input cancellation path) of the second filter module 122 may perform filtration of the composite signal using the determined filtering criteria. In an implementation, the determined filtering criteria may correspond to optimal resultant filter coefficients of the second content adaptive filter of the second filter module 122.

During estimation, the third estimate and the fourth estimate may be initialized with zero values and each of the third estimate and the fourth estimate may be further updated as the estimation continues for each signal frame of the filtered signal or the composite signal in real time.

For the subsequent signal frames of the filtered signal, the Kepstrum logic module 114 may check for content in the instantaneous signal frame. The Kepstrum logic module 114 may retain the third estimate or generate a new third estimate depending on content detected in the instantaneous signal frame. The Kepstrum logic module 114 may further determine a new fourth estimate for corresponding composite signal for each instantaneous signal frame. The comparison of the third estimate or the new third estimate with the new fourth estimate may be performed to determine a new second resultant estimate for the instantaneous signal frame. The new second resultant estimate for the instantaneous signal frame may be used to determine new filtering criteria for the second content adaptive filter of the second filter module 122 for filtration of the composite signal.

Each new filtering criteria may be used to cancel (filter) out components of the first type of signal, which may be still be present in the composite signal. The output of the second content adaptive filter of the second filter module 122 may be referred to as an estimated interference signal and may provide a near optimal estimate of the second type of signal in the composite signal at a given instant. The second content adaptive filter may use strong correlation of second type of signal in the filtered signal of the first filter module 120 with the second type of signal in the composite signal to generate nearest optimal estimate of the second type of signal. The second content adaptive filter may be referred to as a component of a Multiple Input Canceller (MIC) based on instantaneous Kepstrum analysis. Details of such MIC are provided in description of FIG. 2.

With numerous estimations, the output of the second content adaptive filter of the second filter module 122 (or the estimated interference signal) may have distorted phase information. An optimization technique may be implemented by the phase restoration module 126 to recover the phase information of the estimated interference signal. The phase restored interference signal may then be compared with the filtered signal from the first filter module 120 and the components of the second type of signal may be removed to extract the first type of signal. The extracted first type of signal may be referred to as the processed first type of signal or in some exemplary cases, may be referred to as the processed speech signal.

In an exemplary scenario, the signal source 106 may be a user engaged in a distant call conference or may initiate a conversation using the one of one or more communication devices 108, via the communication network 110. The signal processing apparatus 102 and the one of one or more communication devices 108 may correspond to a conference room Public Switched Telephone Network (PSTN) terminal/VoIP terminal or a cell phone. The user may initiate the long distance conference or conversation by a haptic input on the PSTN/VoIP terminal or voice activation. The signal processing apparatus 102, embedded in the PSTN/VoIP terminal or the cell phone, may spatially filter and enhance the user voice/speech using Kepstrum-based spatial filtering in real time from the background noise in the environment and enable the user to communicate with other end with clarity and quality.

In another exemplary scenario, the user may use Interactive Voice Response System (IVRS), via the communication network 110 to authenticate and access using a previous speech profile stored on the data server 112 to access a subscription service. If the user is in a noisy environment, the exact reconstruction of the speech profile of the user may be enabled by the signal processing apparatus 102 based on adaptive beamforming using Kepstrum filter to filter out noises in the noisy background.

Figure 2:
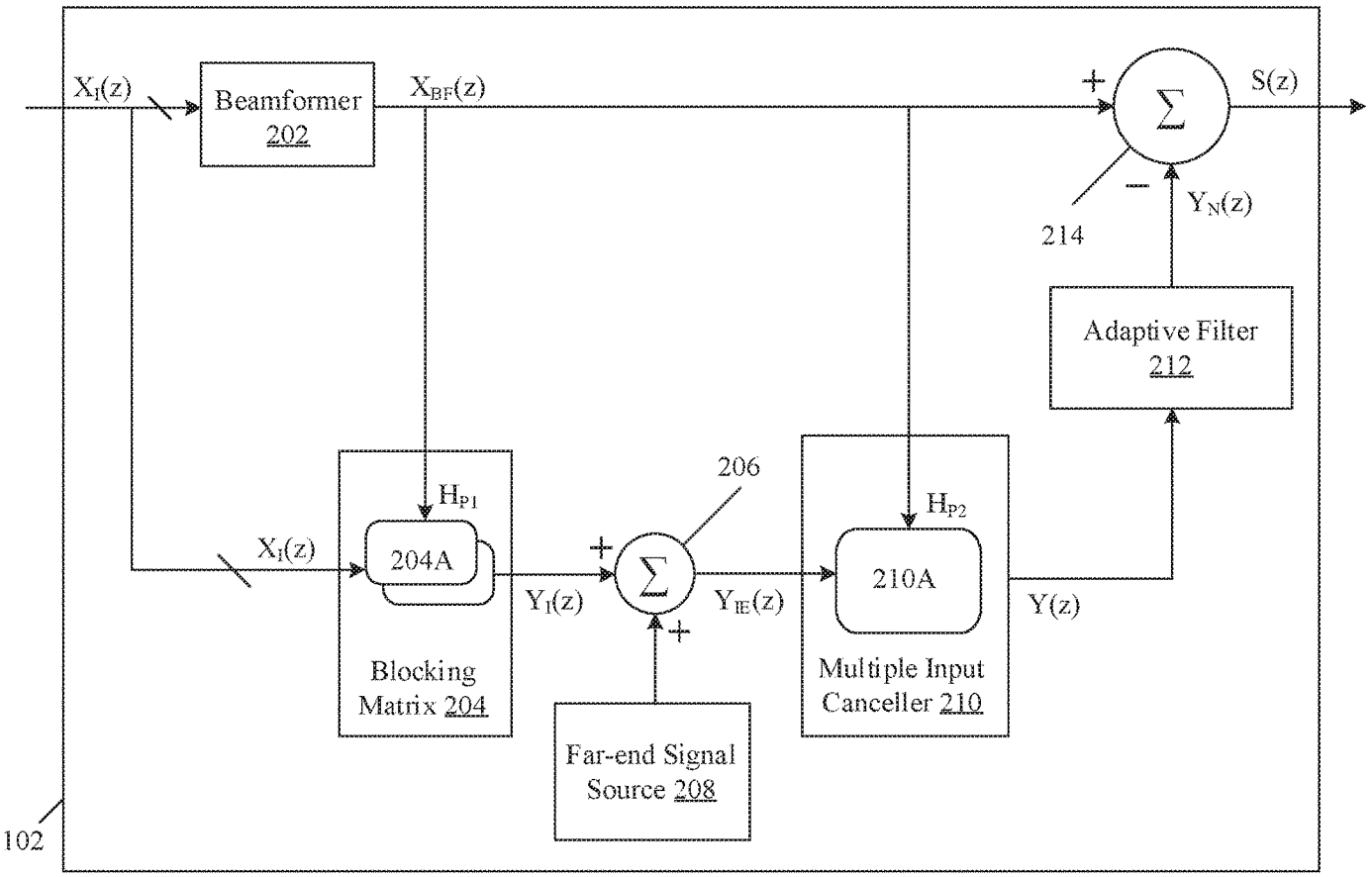
FIG. 2 is a functional block diagram that illustrates an exemplary signal processing apparatus for adaptive beamforming using Kepstrum filters, in accordance with an exemplary embodiment of the disclosure.

FIG. 2 is a functional block diagram that illustrates an exemplary signal processing apparatus for adaptive beamforming using Kepstrum filter, in accordance with an embodiment of the disclosure. Referring to FIG. 2, there is shown a functional block diagram of the signal processing apparatus 102, which comprises a beamformer 202, a blocking matrix 204, an adder circuitry 206, a far-end signal source 208, a multiple input canceller 210, an adaptive filter 212, and a subtraction circuitry 214.

The beamformer 202 may comprise suitable logic, circuitry, and interfaces that may be configured to spatially select a plurality of input signals ($X_I(z)$) from a specific DOA or angle of incidence at speech reception channels of the signal processing apparatus 102. The spatial selection of the plurality of input signals from the specific DOA may correspond to selective reception of beam lobes of the plurality of input signals ($X_I(z)$). The selection may depend on the beam lobes of the plurality of input signals ($X_I(z)$) that may be directed toward the speech reception channels associated with the speech processing apparatus. In accordance with an embodiment, the beamformer 202 may be a delay sum beamformer (DSB). In accordance with another embodiment, the beamformer 202 may be filter-sum beamformer (FSB). In accordance with yet another embodiment, the beamformer 202 may be implemented with a specific beamforming design and technique that may be different from the DSB or the FSB. The beamformer 202 may be further configured to filter (e.g., a maximum filtration) the second type of signal from the plurality of input signals ($X_I(z)$) to obtain a filtered signal ($X_{BF}(z)$). The filtered signal ($X_{BF}(z)$) may comprise a maximum of an amplified first type of signal along with a leaked second type of signal (as interference or noise). In other words, the beamformer 202 may be further configured to filter noise signals from input noisy speech signals to obtain the amplified speech signal having miniscule component of the noise.

The blocking matrix (BM) 204 may comprise suitable logic, circuitry, and interfaces that may be configured to selectively block (or filter) the first type of signal, such as the speech signal, from the plurality of input signals ($X_I(z)$). The BM 204 may correspond to a side lobe cancelling path for elimination of side lobes of the first type of signal. A modelled second type of signal ($Y_I(z)$) may be further obtained from the elimination of side lobes of the first type of signal. The BM 204 may output a signal, which may comprise the second type of signal possibly combined with leaked components of the first type of signal for each signal capturing terminal of the plurality of signal capturing terminals 104. The BM 204 may model the first type of signal and further cancel the first type of signal from the plurality of inputs signals ($X_I(z)$) from each plurality of signal capturing terminals 104 to obtain the modelled second type of signal (($Y_I(z)$). Such modelled second type of signal ($Y_I(z)$) may provide a near estimate of the second type of signal in corresponding plurality of input signals ($X_I(z)$) at a given time instant. The BM 204 may be configured to operate on instantaneous signal frames of the plurality of input signals ($X_I(z)$) and perform instantaneous Kepstrum analysis of each of the instantaneous signal frames to obtain near estimates of the second type of signal. The BM 204 comprises a plurality of Kepstrum filters 204A which may be a type of content adaptive filter (as described in FIG. 1).

The plurality of Kepstrum filters 204A may comprise suitable logic, circuitry, and interfaces that may be configured to filter or cancel out the first type of signal from the plurality of input signals ($X_I(z)$) based on a corresponding filtering criteria derived for each of the plurality of Kepstrum filters 204A. The filtering criteria may correspond to estimated optimum filter coefficients that may be derived from the Kepstrum estimations for each Kepstrum filter of the plurality of Kepstrum filters 204A. The filtration or cancellation of the first type of signal may be based on the generated plurality of estimates (also referred to as the first estimate and the second estimate) for corresponding plurality of input signals. Each estimate of the plurality of estimates may be an estimate of components of the first type of signal in the corresponding plurality of input signals ($X_I(z)$). In other words, each estimate of the plurality of estimates may correspond to an Inverse Fourier Transform (IFT) of logarithmic spectrum of each of the plurality of input signals ($X_I(z)$) in the quefrency domain. Each Kepstrum filter may perform filtration for each signal channel or signal capturing terminal and therefore, the number of Kepstrum filters in BM 204 may be equal to the number of signal channels or the plurality of signal capturing terminals 104.

The adder circuitry 206 may comprise suitable logic, circuitry, and interfaces that may be configured to combine the modelled second type of signal ($Y_I(z)$) and the far-end signals from the far-end signal source 208. The addition of the modelled second type of signal ($Y_I(z)$) with the far-end signals may be based on in-phase of components of the first type of signal in the modelled second type of signal ($Y_I(z)$) and the far-end signals. The adder circuitry 206 may generate a composite signal ($Y_{IE}(z)$) from the addition of the modelled second type of signal ($Y_I(z)$) and the far-end signals.

The far-end signal source 208 may comprise suitable logic, circuitry, and interfaces that may be configured to generate and feed the far-end signals to the adder circuitry 206. The far-end signals may correspond to delay or phase shifted audio signals emanating from the far-end signal source 208, such as a loudspeaker being played far away from the plurality of signal capturing terminals 104. The generated far-end signals may be transmitted to the adder circuitry 206 (as shown) for addition of the far-end signals with the modelled second type of signal ($Y_I(z)$) for generation of the composite signal ($Y_{IE}(z)$).

The multiple input canceller (MIC) 210 may comprise suitable logic, circuitry, and interfaces that may be configured to adaptively filter leakage components of the first type of signal from the generated composite signal ($Y_{IE}(z)$). The adaptive filtration may correspond to instantaneous signal frame based generation of estimations for the first type of signal in the composite signal ($Y_{IE}(z)$) and accordingly, updating the filter-coefficients for the estimations. The MIC 210 comprises a Kepstrum filter 210A which may be a type of content adaptive filter described in FIG. 1.

The Kepstrum filter 210A may comprise suitable logic, circuitry, and interfaces that may be configured to estimate the first type of signal in the generated composite signal ($Y_{IE}(z)$) based on the correlation of the first type of signal with the corresponding first type of signal in the filtered signal ($X_{BF}(z)$) outputted from the beamformer 202. The estimation may be for each signal frame of the composite signal ($Y_{IE}(z)$) and the filter-coefficients may be updated in accordance with the presence of leakage components in the signal frames of the composite signal ($Y_{IE}(z)$). The output from the Kepstrum filter 210A may be referred to as an estimated interference signal ($Y(z)$).

The adaptive filter 212 may comprise suitable logic, circuitry, and interfaces that may be configured to restore the phase information of the estimated interference signal ($Y(z)$) outputted from the Kepstrum filter 210A of the MIC 210. The restoration may be performed in light of a loss of the phase of the estimated interference signal ($Y(z)$) due to Kepstrum estimation of the Kepstrum filter 210A of the MIC 210. The adaptive filter 212 may be an NLMS adaptive filter that may implement NLMS optimization to recover phase of the estimated interference signal ($Y(z)$). The output of the adaptive filter 212 may be referred to as a phase restored interference signal ($Y_N(z)$).

The subtraction circuitry 214 may comprise suitable logic, circuitry, and interfaces that may be configured to extract the first type of signal from the filtered signal ($X_{BF}(z)$) of the beamformer 202 based on filtration of phase restored interference signal ($Y_N(z)$) from the filtered signal ($X_{BF}(z)$) of the beamformer 202. The filtration of the phase restored interference signal ($Y_N(z)$) from the filtered signal ($X_{BF}(z)$) may be based on presence of the first type of signal in the filtered signal ($X_{BF}(z)$). The output of the subtraction circuitry 214 may be referred to as the processed first type of signal or the processed speech signal ($S(z)$), which may be specifically the first type of signal in the filtered signal ($X_{BF}(z)$).

In operation, the plurality of input signals ($X_I(z)$) may be received at input ports of the signal processing apparatus 102. The plurality of the input signals ($X_I(z)$) may be received at each of the plurality of signal capturing terminals 104 (See FIG. 1) associated with the signal processing apparatus 102. The plurality of input signals ($X_I(z)$) may comprise the first type of signal and the second type of signal (as discussed in FIG. 1). In a specific scenario, the first type of signal is a target speech signal of a target user and the second type of signal are composite noise or interference signals, such as babble noise, ambient noise or reverberations received at each of the plurality of signal capturing terminals 104.

The input ports of the signal processing apparatus 102 may be further coupled with the beamformer 202 and the BM 204. The plurality of input signals ($X_I(z)$) may carry the first type of signal from different DOAs. To selectively enhance the first type of signal from a specific DOA, the beamformer 202 may be fed with the plurality of input signals ($X_I(z)$), via signal paths or channels, such as electrical, wireless or optical or suitable network communication paths.

For example, the plurality of signal capturing terminals 104 may be present in a first environment and the signal processing apparatus 102 may be present in a remote environment. The plurality of input signals ($X_I(z)$), captured by the plurality of signal capturing terminals 104, may be transmitted to the signal processing apparatus 102, via the communication network 110. Therefore, the communication network 110 may make use of different communication channels which may comprise at least one of the electrical channels, wireless channels, optical channels, or long-range acoustic channels.

The beamformer 202 may be configured to selectively amplify the first type of signal in the plurality of input signals ($X_I(z)$) and reject the second type of signal in the plurality of input signals ($X_I(z)$). The selective amplification of the first type of signal and rejection of the second type of signal may be performed on the basis of look direction or allowable DOA for the reception of the plurality of input signals ($X_I(z)$).

In other words, beamformer 202 may be configured to receive the first type of signal and the second type of signal as the plurality of input signals ($X_I(z)$). The second type of signal may be adaptively filtered from the plurality of input signals ($X_I(z)$) based on the specific DOA of each of the plurality of input signals ($X_I(z)$) to obtain a filtered signal ($X_{BF}(z)$). Additionally, the second type of signal may be adaptively filtered from the plurality of input signals ($X_I(z)$) based on a count of the plurality of signal capturing terminals 104 and a plurality of inter-terminal spacing between each pair of the plurality of signal capturing terminals 104. The beamformer 202 may be a delay-sum beamformer that may be further configured to constructively add in-phase components of the plurality of input signals ($X_I(z)$), captured from the specific DOA at the plurality of signal capturing terminals 104 (See FIG. 1). The in-phase components of the plurality of input signals ($X_I(z)$) may be outputted as the filtered signal ($X_{BF}(z)$). The beamformer 202 may be further configured to destructively add off-phase components of the plurality of input signals ($X_I(z)$), which may comprise a maximum of the second type of signal received from DOAs different from the specific DOA for the plurality of signal capturing terminals 104. The constructive and destructive addition of in-phase and off-phase components of the plurality of input signals ($X_I(z)$) may result in the filtered signal ($X_{BF}(z)$) having a main lobe pointing to the look direction or the allowable DOA for the plurality of signal capturing terminals 104. As the signal source 106 may be stationary, weights of filters implemented in the beamformer 202 may be static or fixed, such that the look direction or the allowable DOA may be constant.

Each input signal incident at corresponding signal capturing terminal (See FIG. 1) may be delayed by a phase that may be associated with a path length and separation between each signal capturing terminal with neighboring signal capturing terminals. The beamformer 202 may be a multiple input single output circuitry that may be configured to compensate for the delayed phase of each input signal at the corresponding signal capturing terminal. Such phase aligned components may be referred to as in-phase components of the plurality of input signals ($X_I(z)$). The in-phase components are primarily of the first type of signal and the off-phase components are of the second type of signal. The in-phase components may be added together to obtain the filtered signal ($X_{BF}(z)$). The off-phase components of the plurality of input signals may be sub-optimally cancelled, leaving out the filtered signal ($X_{BF}(z)$), combined with leakage of the second type of signal (as unwanted signals).

As the plurality of input signals ($X_I(z)$) may comprise signal frames, each signal processing component of the signal processing apparatus 102 may process the plurality of input signals ($X_I(z)$) frame wise, with each signal frame at a given time. The BM 204 may be further configured to filter out the first type of signal from the plurality of input signals ($X_I(z)$) received from the plurality of signal capturing terminals 104. Such filtration may be performed to obtain a modelled second type of signal ($Y_I(z)$) from the plurality of input signals ($X_I(z)$). To obtain such modelled second type of signal ($Y_I(z)$) from the BM 204, the plurality of Kepstrum filters 204A in the BM 204 may be utilized to perform Kepstrum estimation of the first type of signal in the signal frame of the plurality of input signals ($X_I(z)$) and the corresponding signal frame of the filtered signal ($X_{BF}(z)$). Thereafter, the Kepstrum estimation may be utilized to derive filtering criteria (or an optimum impulse response) of each of the plurality of Kepstrum filters 204A in the BM 204.

For each signal frame of the filtered signal ($X_{BF}(z)$) from the beamformer 202, each corresponding Kepstrum filter may be used to determine a first estimate for each signal frame that corresponds to the first type of signal in the filtered signal ($X_{BF}(z)$). Additionally, for each signal frame of the plurality of input signals ($X_I(z)$) received from the plurality of signal capturing terminals 104, each corresponding Kepstrum filter may be used to determine a second estimate of the first type of signal for corresponding signal capturing terminal associated with the signal processing apparatus 102.

Content of each signal frame from the filtered signal ($X_{BF}(z)$) may be compared for equality with respect to a corresponding target signal (stored or modelled). For equality of the corresponding signal frame of the filtered signal ($X_{BF}(z)$) with the target signal, the first estimate and the second estimate may be destructively combined to obtain a first resultant estimate. For inequality of the corresponding signal frame of the filtered signal ($X_{BF}(z)$) with the target signal, a new first estimate may be obtained. In such cases, the new first estimate may be destructively combined with the second estimate to obtain the first resultant estimate. In other words, a first resultant filter coefficient may be determined for each of the plurality of Kepstrum filters 204A based on comparison of the first filter coefficient and the second filter coefficient for each signal frame in real time.

In terms of filter coefficients, for each signal frame, a new first filter coefficient is estimated for each of the plurality of Kepstrum filters 204A when the content of each signal frame of the filtered signal ($X_{BF}(z)$) is different from content of each signal frame of the target signal. Alternatively, a previously estimated first filter coefficient is utilized when the content of each signal frame of the filtered signal ($X_{BF}(z)$) is equal to content of each signal frame of the target signal. A second filter coefficient is further estimated for each of the plurality of Kepstrum filters 204A. The second filter coefficient is estimated for the presence of the first type of signal in the plurality of input signals ($X_I(z)$). Based on comparison of the estimated first filter coefficient and the estimated second filter coefficient for each signal frame in real time, a first resultant filter coefficient is determined for each of the plurality of Kepstrum filters 204A. The BM 204 and the MIC 210 are adapted during the estimation of the first type of signal in the plurality of input signals. The first resultant filter coefficient may correspond to the first resultant estimate evaluated above. The estimations may be performed by the Kepstrum logic module 114 in conjunction with the processor 116 of the signal processing apparatus 102 (See FIG. 1).

In accordance with an embodiment, the first filter coefficient corresponds to the first estimate of the first type of signal in the filtered signal ($X_{BF}(z)$) and the second filter coefficient corresponds to the second estimate of the first type of signal in the plurality of input signals ($X_I(z)$).

The first resultant estimate may be determined, in conjunction with the corresponding Kepstrum filter, for the plurality of input signals ($X_I(z)$) received from each terminal of the plurality of signal capturing terminals 104. The first resultant estimate may provide near estimate of the first type of signal in the plurality of input signals ($X_I(z)$). Each first resultant estimate may be used to determine filtering criteria for each corresponding Kepstrum filter of the plurality of Kepstrum filters 204A in the BM 204. Each filtering criteria may be utilized to obtain an optimal first impulse response ($H_{P1}(z)$) for the corresponding Kepstrum filter in the BM 204. The first impulse response ($H_{P1}(z)$) may be estimated based on the determined first resultant filter coefficient. The first impulse response ($H_{P1}(z)$) of each of the plurality of Kepstrum filters 204A may be in-phase with respect to each other.

The first impulse response ($H_{P1}(z)$) is estimated based on the estimated first filter coefficient and the estimated second filter coefficient for each Kepstrum filter of the plurality of Kepstrum filters 204A. Specifically, the first impulse response ($H_{P1}(z)$) is estimated based on the determined first resultant filter coefficient. The first filter coefficient and the second filter coefficient may be adapted for each signal frame based on content of each signal frame in real time.

As the first estimate may be referred to as $K_1(z)$, the second estimate may be referred to as $K_2(z)$ and the impulse response of the corresponding Kepstrum filter may be referred to as $H_{P1}(z)$, I/O equation for the corresponding Kepstrum filter of the plurality of Kepstrum filters 204A may be referred to as I/O equations (1) and (2) given below.

$$X_I(z) \times H_{P1}(z) = Y_I(z) \tag{1}$$

$$H_{P1}(z) = \frac{Y_I(z)}{X_I(z)} = \frac{X_{BF}(z)}{X_I(z)} \leftrightarrow (K_1(z) - K_2(z)) \tag{2}$$

For the above I/O equations (1) and (2), the numerator of the first impulse response ($H_{P1}(z)$) may be adapted for presence of the second type of signal in the filtered signal ($X_{BF}(z)$) and the denominator of the first impulse response ($H_{P1}(z)$) may be adapted for the presence of the second type of signal in the plurality of input signals ($X_{BF}(z)$).

As the first impulse response ($H_{P1}(z)$) may be updated to an optimum response for the plurality of Kepstrum filters 204A in the BM 204, the output from the BM 204, that is, the modelled second type of signal ($Y_I(z)$) may comprise the leaked first type of signal. In other words, the BM 204 may output a signal, which may comprise the second type of signal possibly combined with the leaked the first type of signal, for each signal capturing terminal of the plurality of signal capturing terminals 104. The BM 204 models the first type of signal and cancels the first type of signal from the plurality of inputs signals from each plurality of signal capturing terminals 104 to output the modelled second type of signal ($Y_I(z)$). The adder circuitry 206 in the signal processing apparatus 102 may be configured to combine the modelled second type of signal ($Y_I(z)$) with the far-end signals from the far-end signal source 208. The far-end signals may correspond to delay or phase shifted audio signals emanating from the far-end signal source 208, such as a loudspeaker, being played far away from the plurality of signal capturing terminals 104. The adder circuitry 206 may output a composite signal ($Y_{IE}(z)$) from the combination of the modelled second type of signal ($Y_I(z)$) and the far-end signals. In other words, the adder circuitry 206 may be configured to combine the optimum and in-phase impulse response ($H_{P1}(z)$) of the plurality of Kepstrum filters 204A with the far-end data (far-end signals) to obtain the composite signal ($Y_{IE}(z)$).

A third estimate may be obtained by use of the Kepstrum filter 210A for each signal frame that corresponds to the second type of signal in the filtered signal ($X_{BF}(z)$). Additionally, a fourth estimate for the second type of signal may be obtained by use of the Kepstrum filter 210A for each signal frame that corresponds to the composite signal ($Y_{IE}(z)$) received from the adder circuitry 206.

Content of each signal frame from the filtered signal ($X_{BF}(z)$) may be compared for equality with respect to a corresponding target signal (stored or modelled). For equality of the corresponding signal frame of the filtered signal ($X_{BF}(z)$) with the target signal, the third estimate and the fourth estimate may be destructively combined to obtain a second resultant estimate. For inequality of the corresponding signal frame of the filtered signal ($X_{BF}(z)$) with the target signal, a new first estimate may be obtained. In such cases, the new third estimate may be destructively combined with the fourth estimate to obtain the second resultant estimate, which may correspond to an optimum second impulse response ($H_{P2}(z)$) (or filter coefficients) for the Kepstrum filter 210A in the MIC 210. The second resultant estimate for the second type of signal (or interference signals) in the filtered signal ($X_{BF}(z)$) and the composite signal ($Y_{IE}(z)$) may be used to derive the optimum second impulse response ($H_{P2}(z)$) of the Kepstrum filter 210A.

The second resultant estimate may provide near-optimal estimate of interferences (or the second type of signal) in the composite signal ($Y_{IE}(z)$). The second resultant estimate may be used to determine filtering criteria for the Kepstrum filter 210A in the MIC 210.

In terms of filter coefficients, a new third filter coefficient is estimated for the Kepstrum filter 210A when the content of each signal frame in the filtered signal ($X_{BF}(z)$) is different from content of each signal frame of the target signal. Alternatively, a previously estimated third filter coefficient is utilized for the Kepstrum filter 210A when the content of each signal frame of the filtered signal ($X_{BF}(z)$) is equal to content of each signal frame of the target signal. A fourth filter coefficient may be further estimated for the Kepstrum filter 210A based on estimation of the first type of signal in the composite signal ($X_{IE}(z)$). Based on comparison of the estimated third filter coefficient and the estimated fourth filter coefficient for the Kepstrum filter 210A, a second resultant filter coefficient is determined for each signal frame and the second resultant filter coefficient corresponds to the second resultant estimate for the first type of signal in the composite signal ($X_{IE}(z)$). The estimations may be performed by the Kepstrum logic module 114 in conjunction with the processor 116 of the signal processing apparatus 102 (See FIG. 1).

In accordance with an embodiment, the estimated third filter coefficient corresponds to the third estimate of the first type of signal in the filtered signal ($X_{BF}(z)$) and the estimated fourth filter coefficient corresponds to the fourth estimate of the first type of signal in the composite signal ($X_{IE}(z)$).

The second impulse response ($H_{P2}(z)$) is determined for the Kepstrum filter 210A based on the estimated third filter coefficient and the estimated fourth filter coefficient. Specifically, the second impulse response ($H_{P2}(z)$) is estimated based on the determined second resultant filter coefficient. The third filter coefficient and the fourth filter coefficient may be adapted for each signal frame based on the content of each signal frame in real time.

As the third estimate or the new third estimate may be referred to as $K_3(z)$, the fourth estimate may be referred to as $K_4(z)$ and the second impulse response of the Kepstrum filter 210A may be referred to as $H_{P2}(z)$, I/O equation for the Kepstrum filter 210A may be referred to as I/O equations (3) and (4) given below.

$$Y_{IE}(z) \times H_{P2}(z) = Y(z) \tag{3}$$

$$H_{P2}(z) = \frac{Y(z)}{Y_{IE}(z)} = \frac{X_{BF}(z)}{Y_{IE}(z)} \leftrightarrow (K_3(z) - K_4(z)) \tag{4}$$

For the above I/O equations (3) and (4), the numerator of the second impulse response ($H_{P2}(z)$) may be adapted for presence of the second type of signal in the filtered signal ($X_{BF}(z)$) and the denominator of the second impulse response ($H_{P2}(z)$) may be adapted for the presence of the second type of signal in the composite signal ($Y_{IE}(z)$).

The second impulse response ($H_{P2}(z)$) of the Kepstrum filter 210A in the MIC 210 may be updated for the presence of interferences in the filtered signal ($X_{BF}(z)$) and the composite signal ($Y_{IE}(z)$). The Kepstrum filter 210A in the MIC 210 may be configured to reject the leaked first type of signal (or speech signal) from the composite signal ($Y_{IE}(z)$)

sequentially or frame-wise for each signal frame of the composite signal ($Y_{IE}(z)$). The output of the Kepstrum filter 210A may provide an estimated interference signal (Y(z)) (or the second type of signal) having minimal component of the first type of signal. The output may be adaptively generated by the Kepstrum filter 210A for leakage of the first type of signal in the composite signal ($Y_{IE}(z)$) and for zero leakage of the first type of signal in the composite signal ($Y_{IE}(z)$).

With each estimation, the estimated interference signal (Y(z)) may lose the phase information previously associated with the received plurality of input signals ($X_I(z)$). Therefore, each signal frame of the estimated interference signal (Y(z)) may be modified for phase restoration using the adaptive filter 212. The adaptive filter 212 may be an NLMS adaptive filter that may be used to recover phase information of estimated interference signal (Y(z)). The NLMS technique for phase restoration of the estimated interference signal (Y(z)) facilitates adaptive estimation of filter coefficients or weights of the adaptive filter 212. The NLMS technique further facilitates adaptive determination of variable step sizes in accordance with the instantaneous value of the estimated interference signal (Y(z)). The step size or learning rate may be updated for each signal frame based on error estimation and previous weights. The adaptive filter 212 may output a phase restored interference signal ($Y_N(z)$), which may be fed to the subtraction circuitry 214 of the signal processing apparatus 102.

The subtraction circuitry 214 may be configured to receive the filtered signal ($X_{BF}(z)$) from the beamformer 202 and the phase restored interference signal ($Y_N(z)$) from the adaptive filter 212. The subtraction circuitry 214 may be configured to extract the first type of signal from the filtered signal ($X_{BF}(z)$) based on cancellation (or filtration) of the phase restored interference signal ($Y_N(z)$) from the filtered signal ($X_{BF}(z)$). The output from the subtraction circuitry 214 is referred to as the processed first type of signal (S(z)) (or processed speech signal) having high SNR, and noise reduction (NR) performance over multipath reception of the plurality of input signals ($X_I(z)$). In other words, the speech signal (S(z)), extracted from the filtered signal ($X_{BF}(z)$) exhibits high SNR and NR performance over multipath reception of the plurality of input signals ($X_I(z)$). The multipath reception of the plurality of input signals may correspond to reception of the plurality of input signals from different arrival paths. Such arrival paths are formed due to reflection, reverberation, or partial absorption of the first type of signal by different object/obstacles present between the signal source 106 and the plurality of signal capturing terminals 104.

Figure 3A:
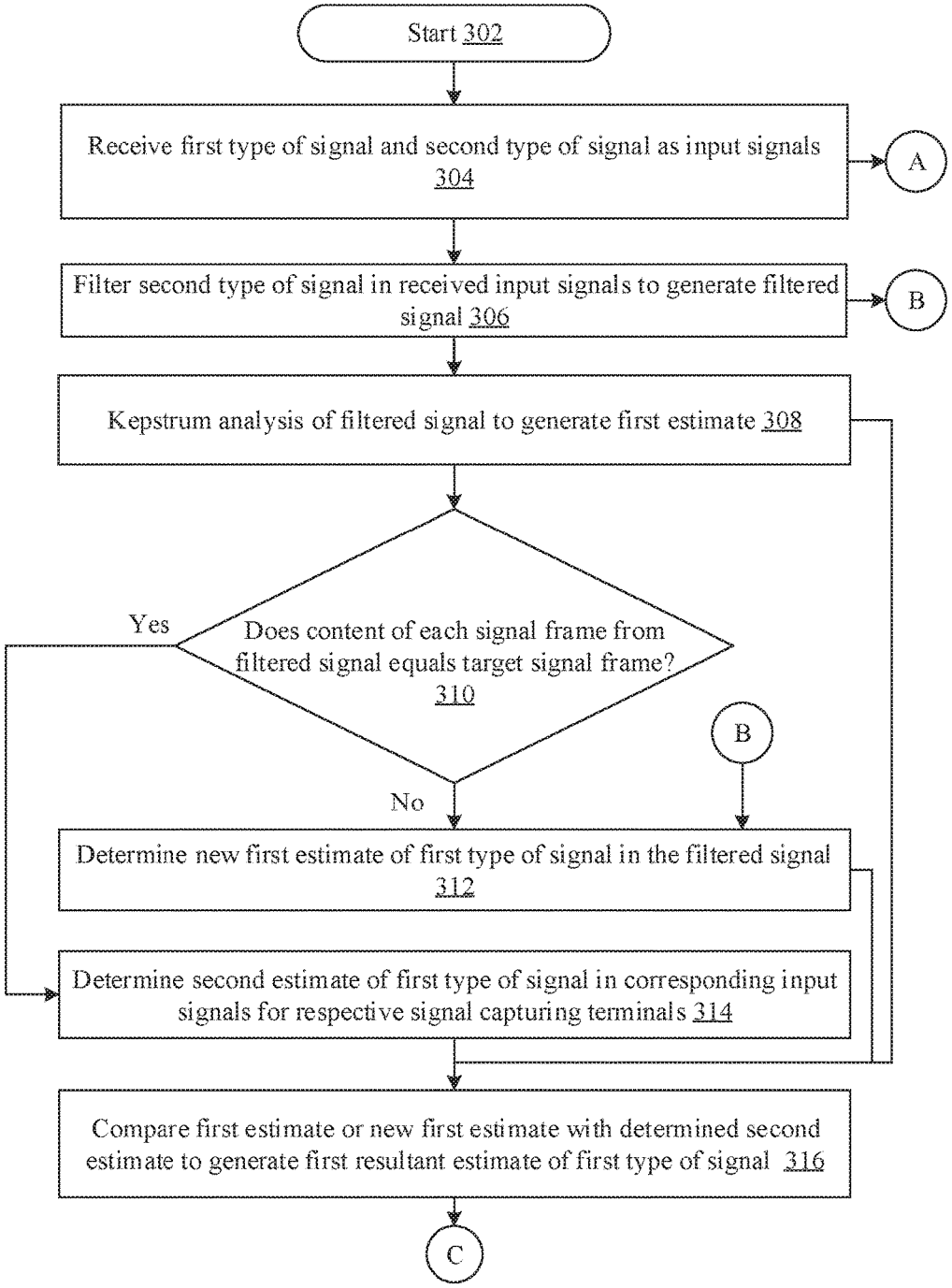
FIG. 3A, FIG. 3B, and FIG. 3C, collectively, depicts a flow chart that illustrates exemplary operations for adaptive beamforming using Kepstrum filters of the signal processing apparatus illustrated in FIG. 1, in accordance with various exemplary embodiments of the disclosure.
Figure 3B:
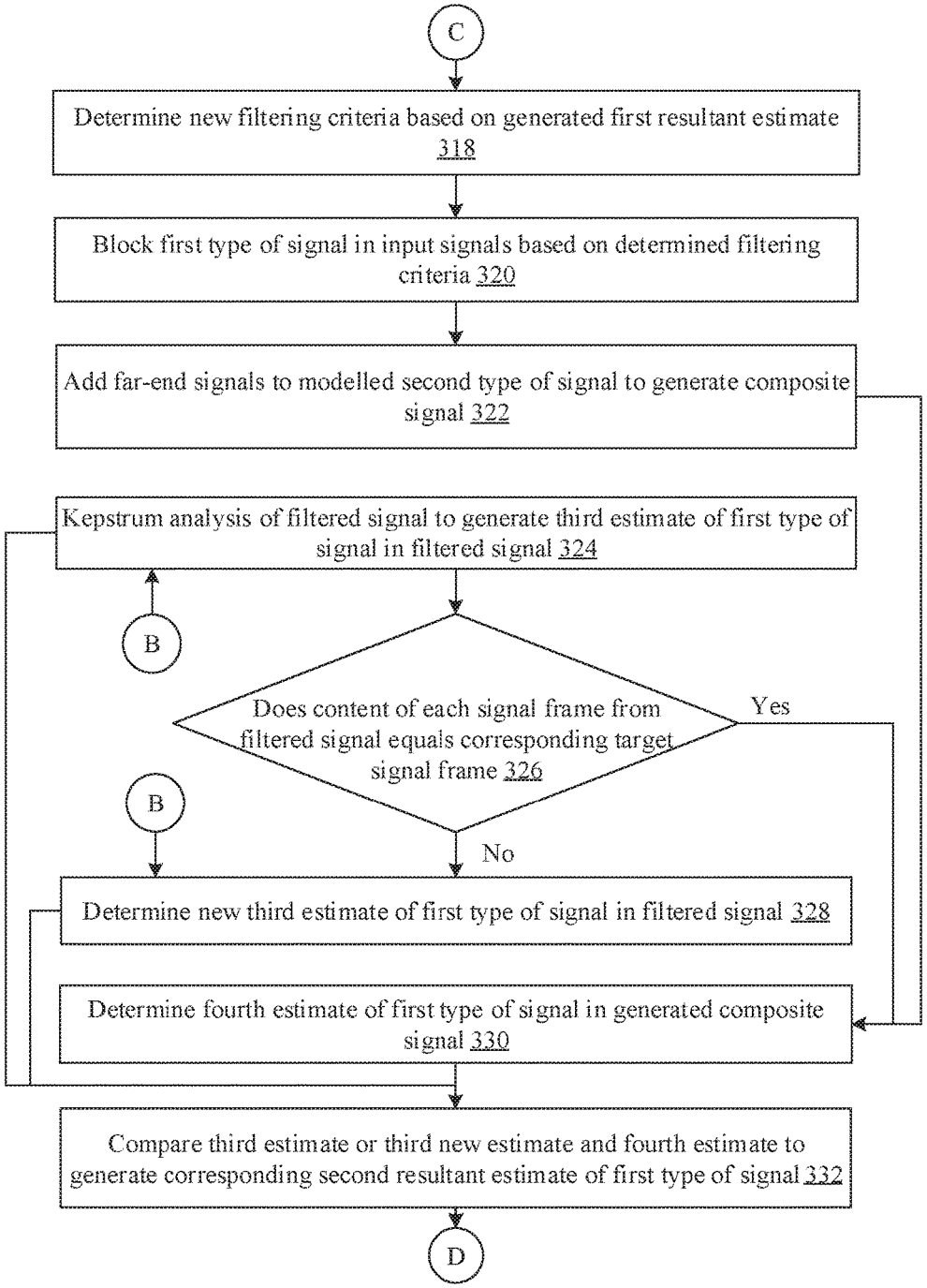
Figure 3C:
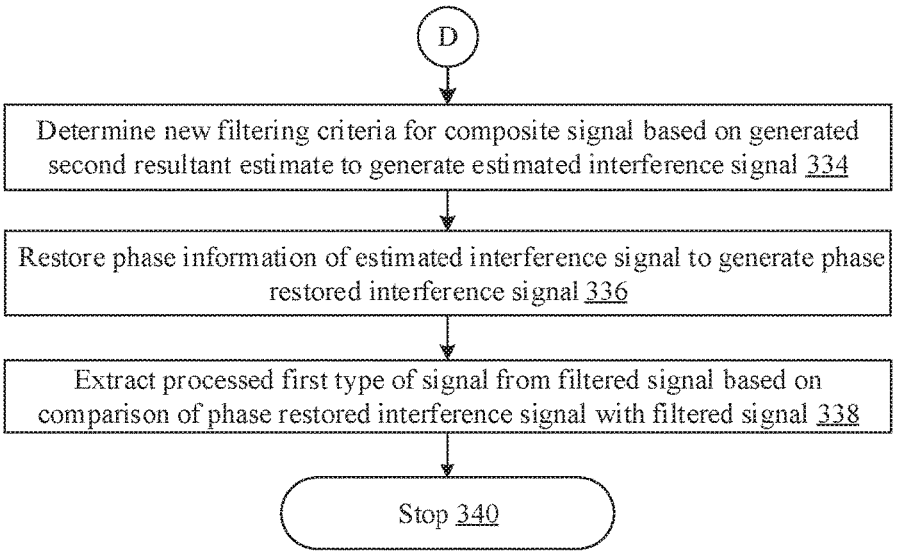

FIG. 3A, FIG. 3B, and FIG. 3C, collectively, depicts a flowchart that illustrates exemplary operations for adaptive beamforming using Kepstrum filters, in accordance with various exemplary embodiments of the disclosure. FIG. 3A, FIG. 3B, and FIG. 3C have been described in conjunction with elements from FIG. 1 and FIG. 2. FIG. 3A shows a flowchart comprising exemplary operations from 302 through 340. The flowchart may start at 302 and proceed to 304.

At 304, a first type of signal and a second type of signal is received as a plurality input signals. The plurality of signal capturing terminals 104 may be configured to receive the first type of signal and the correlated second type of signal as the plurality input signals. The first type of signal and the correlated second type of signal are received from the signal source 106. In accordance with an embodiment, the plurality of input signals may be multiplexed, digitized, and packetized into a plurality of signal frames. Each signal frame may correspond to the digitized plurality of input signals of a defined duration, such as 10 milliseconds (as described in detail in FIG. 1 and FIG. 2).

At 306, second type of signal in the received plurality of input signals is filtered to generate a filtered signal. The first filter module 120 may be configured to filter the second type of signal in the received plurality of input signals to generate the filtered signal. Additionally, the first type of signal is amplified and combined to generate a filtered signal. For each signal frame, the second type of signal may be filtered on the basis of angle of incidence of the plurality of input signals at the plurality of signal capturing terminals 104. The first filter module 120 may be configured to constructively combine plurality of input signals at particular angles of incidence at the plurality of signal capturing terminals 104 to generate a filtered signal. The filtered signal may enable establishment of a sensitivity pattern. The sensitivity pattern may provide an estimate of direction of the signal source 106 in the communication environment 100. The directional sensitivity enables the signal processing apparatus 102 to focus on the plurality of input signals from the estimated direction of the signal source 106 in the communication environment 100 while ignoring another plurality of input signals from directions different from the estimated direction of the signal source 106 in the communication environment 100 (as described in detail in FIG. 1 and FIG. 2).

At 308, Kepstrum analysis of the filtered signal may be performed to generate a first estimate of the first type of signal in the filtered signal. The Kepstrum logic module 114 may perform the Kepstrum analysis of the filtered signal to generate the first estimate of the first type of signal in the filtered signal. The Kepstrum analysis may de-convolute the filtered signal to estimate the first type of signal in the filtered signal. For subsequent signal frames, the filtered signal may be analyzed using the previously estimated first estimate (as described in detail in FIG. 1 and FIG. 2).

At 310, it may be determined that content of each signal frame from the filtered signal is equal to a corresponding target signal (stored or modelled). The Kepstrum logic module 114 may be configured to determine that the content of each signal frame from the filtered signal is equal to the corresponding target signal. For equality of the corresponding signal frame of the filtered signal with the target signal, the control passes to 314. For inequality of the corresponding signal frame of the filtered signal with the target signal, control passes to 312 (as described in detail in FIG. 1 and FIG. 2).

At 312, new first estimate of the first type of signal in the filtered signal (from 306) may be determined. The Kepstrum logic module 114 may determine the new first estimate for the first type of signal in the filtered signal. The first estimate may be updated dynamically for each instantaneous signal frame depending upon the content detected in the instantaneous signal frame until the next determination may be performed at 312 for the next signal frame (as described in detail in FIG. 1 and FIG. 2).

At 314, second estimate of the first type of signal in the corresponding plurality of input signals is determined for the respective plurality of signal capturing terminals 104. The Kepstrum logic module 114 may determine the second estimate of the first type of signal in the corresponding plurality of input signals. The Kepstrum logic module 114 may perform Kepstrum analysis of the plurality of input signals to generate the second estimate of the first type of signal in the plurality of input signals (as described in detail in FIG. 1 and FIG. 2).

At 316, first estimate or new first estimate is compared with determined second estimate to generate a first resultant estimate of first type of signal in the plurality of input signals. The Kepstrum logic module 114 may be configured to compare the first estimate with the second estimate based on each signal frame of the target signal. The first resultant estimate may provide near optimal estimate of the first type of signal in corresponding plurality of input signals captured at respective terminal of the plurality of signal capturing terminals 104 for each signal frame (as described in detail in FIG. 1 and FIG. 2).

At 318, new filtering criteria is determined based on the generated first resultant estimate of the first type of signal in the plurality of input signals. The Kepstrum logic module 114 may be configured to determine the new filtering criteria for the plurality of first content adaptive filters in the second filter module 122 based on the generated first resultant estimate of the first type of signal in the plurality of input signals. The new filtering criteria may correspond to optimally estimated filter coefficients for each of the plurality of first content adaptive filters (as described in detail in FIG. 1 and FIG. 2).

At 320, first type of signal in the plurality of input signals is blocked (or filtered) from the plurality of input signals based on the determined new filtering criteria. Each of the first content adaptive filter in the second filter module 122 may be configured to block the first type of signal from the plurality of input signals to provide a near optimal estimation of the second type of signal in the plurality of input signals (as described in detail in FIG. 1 and FIG. 2).

At 322, far-end signal(s) from the far-end playback module 124 are added to the modelled second type of signal to generate a composite signal. The adder circuitry 206 may be configured to add the far-end signal(s) from the far-end playback module 124 to the modelled second type of signal to generate the composite signal. The far-end signals may be phase compensated versions of the first type of signal. The plurality of composite signals may include a leaked first type of signal that exhibits varying degree of correlation with components of the second type of signal (as described in detail in FIG. 1 and FIG. 2).

At 324, Kepstrum analysis of the filtered signal (from 306) may be performed again to generate a third estimate of the first type of signal in the filtered signal. The Kepstrum logic module 114 may perform the Kepstrum analysis of the filtered signal to generate the third estimate of the first type of signal in the filtered signal. The Kepstrum analysis may de-convolute the filtered signal to estimate the first type of signal in the filtered signal. The Kepstrum analysis may generate a third estimate of the first type of signal in the filtered signal for the first signal frame. For subsequent signal frames, the filtered signal from 306 may be analyzed using the existing third estimate (as described in detail in FIG. 1 and FIG. 2).

At 326, it may be determined that the content of each signal frame from the filtered signal is equal to a corresponding target signal frame (stored or modelled). The Kepstrum logic module 114 may be configured to determine whether the content of each signal frame from the filtered signal is equal to the corresponding target signal frame. For equality of the corresponding signal frame of the filtered signal with the target signal frame, the control passes to 330. For inequality of the corresponding signal frame of the filtered signal with the target signal frame, control passes to 328 (as described in detail in FIG. 1 and FIG. 2).

At 328, a new third estimate of the first type of signal in the filtered signal (from 306) may be determined. The Kepstrum logic module 114 may be configured to determine the new third estimate of the first type of signal in the filtered signal for each corresponding signal frame. The new third estimate may be determined for each signal frame of the filtered signal (as described in detail in FIG. 1 and FIG. 2).

At 330, fourth estimate of the first type of signal in the generated composite signal (obtained at 320) may be determined. The Kepstrum logic module 114 may be configured to determine the fourth estimate of the first type of signal in the composite signal. The fourth estimate may be determined for each signal frame of the composite signal (as described in detail in FIG. 1 and FIG. 2).

At 332, new third estimate or third estimate is compared with the fourth estimate to generate a second resultant estimate of first type of signal in the composite signal. The Kepstrum logic module 114 may be configured to compare the third estimate or the new third estimate with the fourth estimate to generate the second resultant estimate of the first type of signal in the composite signal. The second resultant estimate may provide a near-optimal estimate of the first type of signal in the respective composite signal (as described in detail in FIG. 1 and FIG. 2).

At 334, new filtering criteria for the composite signal is determined based on the generated second resultant estimate to generate estimated interference signal. The new filtering criteria may be used to configure the second content adaptive filter of the second filter module 122 for the generation of the estimated interference signal. The Kepstrum logic module 114 may be configured to determine the new filtering criteria for the second content adaptive filter of the second filter module 122 to generate the estimated interference signal (as described in FIG. 1 and FIG. 2).

At 336, phase information of the estimated interference signal may be restored to generate a phase restored interference signal. The phase restoration module 126 may be configured to restore the phase information of the estimated interference signal to generate the phase restored interference signal. The estimated interference signal exhibits phase distortion due to consecutive Kepstrum estimation and therefore, the phase restoration may be performed using an optimization technique based on NLMS (as described in detail in FIG. 1 and FIG. 2).

At 338, processed first type of signal is extracted from the filtered signal based on comparison of the phase restored interference signal with the filtered signal. The subtraction circuitry 214 may be configured to compare the phase restored interference signal with the filtered signal to generate the processed first type of signal (or processed speech signal). Control ends at 340.

The present disclosure provides several advantages over the prior art. The convergence and divergence of filters during talk-spurt classification error for any change in the direction of target signal as well as switching across target and interference signal is avoided due to implementation of Kepstrum-based estimation of impulse response of adaptive filters for estimation of signals. In the proposed solution, the impulse response of the Kepstrum-based adaptive filters may be estimated for every frame without using error signals. Therefore, issues related to usage of estimation error while estimating the impulse response may be avoided. The proposed solution estimates near-optimum impulse response for every frame and therefore, the convergence of the Kepstrum-based adaptive filters is instant. Human machine interface applications such as a virtual voice assistant using automatic speech recognition (ASR) performs better when beamformers track single target source at a time. Hence, tracking the direction of speech during babble noise condition leads to beam shifting across users and leads to more failures for human queries. Therefore, the direction of target source is estimated during voice trigger and is used until the next voice trigger is detected. The proposed solution further provides signal output (specifically speech output) of high SNR and NR performance.

While the present disclosure has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, various embodiments described above may be combined with each other.

As utilized herein, the terms "circuits" and "circuitry" refer to physical electronic components (i.e. hardware) and any software and/or firmware ("code") which may configure the hardware, be executed by the hardware, and/or otherwise be associated with the hardware. As used herein, for example, a particular processor and memory may comprise a first "circuit" when executing first one or more lines of code and may comprise a second "circuit" when executing second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g. and for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

The terminology used herein is for the purpose of describing particular embodiments only and is not intended to be limiting of embodiments of the disclosure. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, these sequence of actions described herein can be considered to be embodied entirely within any non-transitory form of computer readable storage medium having stored therein a corresponding set of computer instructions that upon execution would cause an associated processor to perform the functionality described herein. Thus, the various aspects of the disclosure may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Another embodiment of the disclosure may provide a non-transitory machine and/or computer readable storage and/or media, having stored thereon, a machine code and/or a computer program having at least one code section executable by a machine and/or a computer, thereby causing the machine and/or computer to perform the steps as described herein for adaptive enhancement of speech signals.

The present disclosure may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

Further, those of skill in the art will appreciate that the various illustrative logical blocks, modules, circuits, techniques, and/or steps described in connection with the embodiments disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The methods, sequences and/or techniques described in connection with the embodiments disclosed herein may be embodied directly in firmware, hardware, in a software module executed by a processor, or in a combination thereof. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

While the present disclosure has been described with reference to certain embodiments, it will be noted understood by, for example, those skilled in the art that various changes and modification could be made and equivalents may be substituted without departing from the scope of the present disclosure as defined, for example, in the appended claims. In addition, many modifications may be made to adapt a particular situation or material to the teachings of the present disclosure without departing from its scope. The functions, steps and/or actions of the method claims in accordance with the embodiments of the disclosure described herein need not be performed in any particular order. Furthermore, although elements of the disclosure may be described or claimed in the singular, the plural is contemplated unless limitation to the singular is explicitly stated. Therefore, it is intended that the present disclosure not be limited to the particular embodiment disclosed, but that the present disclosure will include all embodiments falling within the scope of the appended claims.

What is claimed is:

1. A system, comprising:

a plurality of circuits in a signal processing apparatus, the plurality of circuits is configured to:

generate a filtered signal from a plurality of input signals, wherein the plurality of input signals is received from each of a plurality of signal capturing terminals, wherein each of the plurality of input signals comprises a first type of signal and a second type of signal;

determine, for each signal frame, a first resultant estimate of the first type of signal in the plurality of input signals, received from each of the plurality of signal capturing terminals, based on a first impulse response of each first content adaptive filter of a plurality of first content adaptive filters;

determine, for each signal frame, a second resultant estimate of the first type of signal in a composite signal based on a second impulse response of a second content adaptive filter;

restore phase information of an estimated interference signal, obtained from the second content adaptive filter configured with the determined second resultant estimate, to obtain a phase restored interference signal; and extract the first type of signal from the filtered signal based on filtration of the phase restored interference signal from the filtered signal.

2. The system according to claim 1, wherein the plurality of circuits is further configured to estimate, for each signal frame, a new first filter coefficient for each of the plurality of first content adaptive filters based on inequality of content of each signal frame of the filtered signal and the content of each signal frame of a target signal.

3. The system according to claim 1, wherein the plurality of circuits is further configured to utilize a previously estimated first filter coefficient based on content of each signal frame of the filtered signal and the content of each signal frame of a target signal.

4. The system according to claim 1, wherein the plurality of circuits is further configured to estimate a second filter coefficient for each of the plurality of first content adaptive filters.

5. The system according to claim 1, wherein the plurality of circuits is further configured to estimate the first impulse response based on an estimated first filter coefficient and an estimated second filter coefficient for each first content adaptive filter of the plurality of first content adaptive filters, and wherein the first filter coefficient corresponds to a first estimate of the first type of signal in the filtered signal and the second filter coefficient corresponds to a second estimate of the first type of signal in the plurality of input signals.

6. The system according to claim 1, wherein the plurality of circuits is further configured to determine a first resultant filter coefficient for each of the plurality of first content adaptive filters based on comparison of a first filter coefficient and a second filter coefficient for each signal frame in real time, wherein the first resultant filter coefficient corresponds to the first resultant estimate.

7. The system according to claim 6, wherein the first impulse response is estimated based on the determined first resultant filter coefficient.

8. The system according to claim 1, wherein the plurality of circuits is further configured to estimate, for each signal frame, a new third filter coefficient for the second content adaptive filter based on inequality of content of each signal frame of the filtered signal and the content of each signal frame of a target signal.

9. The system according to claim 1, wherein the plurality of circuits is further configured to utilize a previously estimated third filter coefficient for the second content adaptive filter based on equality of content of each signal frame of the filtered signal and the content of each signal frame of a target signal.

10. The system according to claim 1, wherein the plurality of circuits is further configured to estimate a fourth filter coefficient for the second content adaptive filter based on estimation of the first type of signal in the composite signal.

11. The system according to claim 1, wherein the plurality of circuits is further configured to determine, for each signal frame, a second resultant filter coefficient based on comparison of an estimated third filter coefficient and an estimated fourth filter coefficient for the second content adaptive filter, and wherein the second resultant filter coefficient corresponds to the second resultant estimate.

12. The system according to claim 1, wherein the plurality of circuits is further configured to estimate the second impulse response based on an estimated third filter coefficient and an estimated fourth filter coefficient, wherein the estimated third filter coefficient corresponds to a third estimate of the first type of signal in the filtered signal and the estimated fourth filter coefficient corresponds to a fourth estimate of the first type of signal in the composite signal, and wherein the third filter coefficient and the fourth filter coefficient are adapted for each signal frame based on a content of each signal frame.

13. The system according to claim 12, wherein the second impulse response is estimated based on a determined second resultant filter coefficient.

14. The system according to claim 1, wherein the plurality of circuits is further configured to:

receive the first type of signal and the second type of signal as the plurality of input signals; and filter the second type of signal from the plurality of input signals to obtain the filtered signal based on a direction of arrival of each of the plurality of input signals.

15. The system according to claim 1, wherein the first type of signal corresponds to a target signal, wherein the second type of signal corresponds to a plurality of interference signals, and wherein the plurality of interference signals comprises at least one of ambient noise, babble noise, and reverberation.

16. The system according to claim 1, wherein the plurality of circuits is further configured to filter the second type of signal from the filtered signal to obtain a processed first type of signal.

17. The system according to claim 1, wherein each of the plurality of signal capturing terminals corresponds to a unidirectional terminal.

18. The system according to claim 1, wherein the signal frame is a burst of sound signals of a defined duration.

19. The system according to claim 1, wherein each of the plurality of first content adaptive filters and the second content adaptive filter is implemented by use of a Kepstrum filter in time domain.

20. A method, comprising:

in a signal processing apparatus that comprises a plurality of circuits:

generating, by the plurality of circuits, a filtered signal from a plurality of input signals, wherein the plurality of input signals is received from each of a plurality of signal capturing terminals, wherein each of the plurality of input signals comprises a first type of signal and a second type of signal;

determining, by the plurality of circuits, for each signal frame, a first resultant estimate of the first type of signal in the plurality of input signals, received from each of the plurality of signal capturing terminals, based on a first impulse response of each first content adaptive filter of a plurality of first content adaptive filters;

determining, by the plurality of circuits, for each signal frame, a second resultant estimate of the first type of signal in a composite signal based on a second impulse response of a second content adaptive filter;

restoring, by the plurality of circuits, phase information of an estimated interference signal, obtained from the second content adaptive filter configured with the determined second resultant estimate, to obtain a phase restored interference signal; and extracting, by the plurality of circuits, the first type of signal from the filtered signal based on filtration of the phase restored interference signal from the filtered signal.

21. The method according to claim 20, further comprising estimating, by the plurality of circuits, for each signal frame, a new first filter coefficient for each of the plurality of first content adaptive filters based on inequality of content of each signal frame of the filtered signal and the content of each signal frame of a target signal.

22. The method according to claim 20, further comprising utilizing, by the plurality of circuits, a previously estimated first filter coefficient based on equality of content of each signal frame of the filtered signal and the content of each signal frame of a target signal.

23. The method according to claim 20, further comprising estimating, by the plurality of circuits, a second filter coefficient for each of the plurality of first content adaptive filters.

24. The method according to claim 20, further comprising estimating, by the plurality of circuits, the first impulse response based on an estimated first filter coefficient and an estimated second filter coefficient for each first content adaptive filter of the plurality of first content adaptive filters, and wherein the first filter coefficient corresponds to a first estimate of the first type of signal in the filtered signal and the second filter coefficient corresponds to a second estimate of the first type of signal in the plurality of input signals.

25. The method according to claim 20, further comprising determining, by the plurality of circuits, a first resultant filter coefficient for each of the plurality of first content adaptive filters based on comparison of a first filter coefficient and a second filter coefficient for each signal frame in real time, wherein the first resultant filter coefficient corresponds to the first resultant estimate.

26. The method according to claim 25, wherein the first impulse response is estimated based on the determined first resultant filter coefficient.

27. The method according to claim 20, further comprising estimating, by the plurality of circuits, for each signal frame, a new third filter coefficient for the second content adaptive filter based on inequality of content of each signal frame in the filtered signal and the content of each signal frame of a target signal.

28. The method according to claim 20, further comprising, utilizing, by the plurality of circuits, a previously estimated third filter coefficient for the second content adaptive filter based on equality of content of each signal frame of the filtered signal and the content of each signal frame of a target signal.

29. The method according to claim 20, further comprising estimating, by the plurality of circuits, a fourth filter coefficient for the second content adaptive filter based on estimation of the first type of signal in the composite signal.

30. The method according to claim 20, further comprising determining, by the plurality of circuits, for each signal frame, a second resultant filter coefficient based on comparison of an estimated third filter coefficient and an estimated fourth filter coefficient for the second content adaptive filter, and wherein the second resultant filter coefficient corresponds to the second resultant estimate.

31. The method according to claim 20, further comprising estimating, by the plurality of circuits, the second impulse response based on an estimated third filter coefficient and an estimated fourth filter coefficient, wherein the estimated third filter coefficient corresponds to a third estimate of the first type of signal in the filtered signal and the estimated fourth filter coefficient corresponds to a fourth estimate of the first type of signal in the composite signal, and wherein the third filter coefficient and the fourth filter coefficient are adapted for each signal frame based on a content of each signal frame.

32. The method according to claim 31, wherein the second impulse response is estimated based on a determined second resultant filter coefficient.

33. A signal processing apparatus, comprising:

a first circuitry, coupled to a plurality of signal capturing terminals, wherein the first circuitry is configured to receive a plurality of input signals captured by each of the plurality of signal capturing terminals to generate a filtered signal, wherein each of the plurality of input signals comprises a first type of signal and a second type of signal;

a second circuitry coupled to the first circuitry and the plurality of signal capturing terminals, wherein the second circuitry includes a plurality of first content adaptive filters, and wherein each of the plurality of first content adaptive filters is configured to determine, for each signal frame, a first resultant estimate of the first type of signal in the plurality of input signals, received from each of the plurality of signal capturing terminals, based on a first impulse response of each first content adaptive filter of a plurality of first content adaptive filters;

a third circuitry coupled to the plurality of signal capturing terminals, wherein the third circuitry includes a second content adaptive filter, and wherein the second content adaptive filter is configured to determine, for each signal frame, a second resultant estimate of the first type of signal in a composite signal based on a second impulse response of a second content adaptive filter;

a fourth circuitry coupled to the third circuitry, wherein the fourth circuitry is configured to restore phase information of an estimated interference signal, obtained from the second content adaptive filter configured with the determined second resultant estimate, to obtain a phase restored interference signal; and a subtraction circuitry coupled to the first circuitry and the fourth circuitry, wherein the subtraction circuitry is configured to extract the first type of signal from the filtered signal based on filtration of the phase restored interference signal from the filtered signal.

* * * * *